US011519170B2

(12) United States Patent
Tinwala et al.

(10) Patent No.: US 11,519,170 B2
(45) Date of Patent: Dec. 6, 2022

(54) SMOKE BAFFLE SYSTEM

(71) Applicants: Murtuza Tinwala, Lewisville, TX (US); Ryan Fitzgerald, Richardson, TX (US)

(72) Inventors: Murtuza Tinwala, Lewisville, TX (US); Ryan Fitzgerald, Richardson, TX (US)

( * ) Notice: Subject to any disclaimer, the term of this patent is extended or adjusted under 35 U.S.C. 154(b) by 0 days.

(21) Appl. No.: 17/197,372

(22) Filed: Mar. 10, 2021

(65) Prior Publication Data

US 2022/0290433 A1 Sep. 15, 2022

(51) Int. Cl.
*E04B 9/36* (2006.01)
*E04B 1/94* (2006.01)

(52) U.S. Cl.
CPC ..... *E04B 9/366* (2013.01); *E04B 1/946* (2013.01)

(58) Field of Classification Search
CPC ..... E04B 9/366; E04B 1/946; E04B 9/183; E04B 9/064; Y10T 403/7043
See application file for complete search history.

(56) References Cited

U.S. PATENT DOCUMENTS

| | | | | |
|---|---|---|---|---|
| 3,436,047 | A * | 4/1969 | Foltz | A47H 1/104 104/111 |
| 4,703,598 | A * | 11/1987 | Wilson | E04B 2/7409 52/204.591 |
| 8,555,594 | B2 * | 10/2013 | Grandi | E04B 9/008 52/506.01 |
| 9,920,525 | B1 * | 3/2018 | Underkofler | E04B 1/8209 |
| 10,563,399 | B2 * | 2/2020 | Pilz | E04B 1/38 |
| 2022/0074203 | A1 * | 3/2022 | Cavasinni | E04B 9/0464 |

FOREIGN PATENT DOCUMENTS

DE 2435301 A1 * 2/1976

* cited by examiner

*Primary Examiner* — Adriana Figueroa
(74) *Attorney, Agent, or Firm* — Stephen Y. Liu; James R. Gourley; Carstens, Allen & Gourley, LLP

(57) ABSTRACT

A system and corresponding method for suspending a set of panels. The system includes a mounting rail with a base having a first side and a second side. The first side of the base defines a planar surface configured to be secured against a structural support member and the second side includes a curved surface. The system also includes an alignment rail with a curved base, the alignment rail rotatably secured to the mounting rail along a pair of curved mating surfaces. The pair of curved mating surfaces is formed from the curved surface of the mounting rail and the curved base of the alignment rail. Additionally, the system includes a panel secured to the alignment rail.

16 Claims, 7 Drawing Sheets

SMOKE BAFFLE SYSTEM

BACKGROUND OF THE INVENTION

Technical Field

The present invention relates to a mounting system for panels, more specifically, a system for suspending panels to form a smoke baffle system.

Description of Related Art

Smoke from a fire burning inside of a structure rises and then spreads along a ceiling until it finds a path to move to upper floors. For example, the smoke can travel from one floor to another through slab openings, such as stairwells or atriums. The flow of smoke between floors can be delayed by a smoke baffle system, which can provide occupants additional time to evacuate and limit the amount of damage to the structure. The smoke baffle system is a barrier, often suspended from an overhead position and from a structural support member such as a ceiling slab or joist and aligned along a perimeter of the slab openings.

SUMMARY OF THE INVENTION

Novel aspects of the present disclosure are directed to a system for suspending a set of panels. The system includes a mounting rail with a base having a first side and a second side. The first side of the base defines a planar surface configured to be secured against a structural support member, and the second side includes a curved surface. The system also includes an alignment rail with a curved base, the alignment rail rotatably secured to the mounting rail along a pair of curved mating surfaces. The pair of curved mating surfaces is formed from the curved surface of the mounting rail and the curved base of the alignment rail. Additionally, the system includes a panel secured to the alignment rail.

Additionally, novel aspects of the present disclosure are directed to a method for installing the system for suspending a set of panels. The method includes the steps of aligning a set of mounting rails with a perimeter of a slab opening; securing the set of mounting rails to a structural support member at the perimeter of the slab opening; aligning a curved surface of the mounting rail with a curved base of the alignment rail; securing the alignment rail to the mounting rail at the curved mating surface; and securing the panel to the alignment rail. In a non-limiting embodiment, the curved surface of the mounting rail and the curved base of the alignment rail form a curved mating surface.

BRIEF DESCRIPTIONS OF THE DRAWINGS

The novel features believed characteristic of the invention are set forth in the appended claims. The invention itself, however, as well as a preferred mode of use, further objectives, and advantages thereof, will be best understood by reference to the following detailed description of illustrative embodiments when read in conjunction with the accompanying drawings, wherein:

DETAILED DESCRIPTION OF THE INVENTION

Several embodiments incorporating novel aspects of the disclosure will now be described with reference to the drawings. Unless otherwise noted, like elements will be identified by identical numbers throughout all figures. The invention illustratively disclosed herein suitably may be practiced in the absence of any element which is not specifically disclosed herein.

The design of smoke baffle systems can be dictated by aesthetic requirements specifying the types of material that can be used for the panel and the manner in which the panels are mounted. For example, recent trends have shown an increased preference for glass panels, which are easily damaged and hard to mount, and for the implementation of less obtrusive mounting hardware. The designs of smoke baffle systems can also be dictated by installation timing requirements. For example, smoke baffle systems are typically installed after construction has been mostly completed, when mounting locations are often concealed and/or difficult to access, which can limit installation methods and the types of mounting hardware used. However, mounting smoke baffles during construction can result in installation onto structural support members that have not been leveled, yielding out of plumb panels and panels that can be exposed to damage while construction is completed.

Accordingly, novel aspects of this disclosure are directed to a smoke baffle system that recognizes the following needs: the ability to begin the installation process of the smoke baffle system during construction when the structural support members are easily accessible; the ability to complete the installation of the panels at a later time when they are less prone to damage; and the ability to mitigate the effects of a structural support member that can cause the panels to be out of plumb. Novel aspects of this disclosure also recognize the need to be able to mount any type of panel while concealing the mounting hardware to satisfy design aesthetic requirements.

Figure 1:
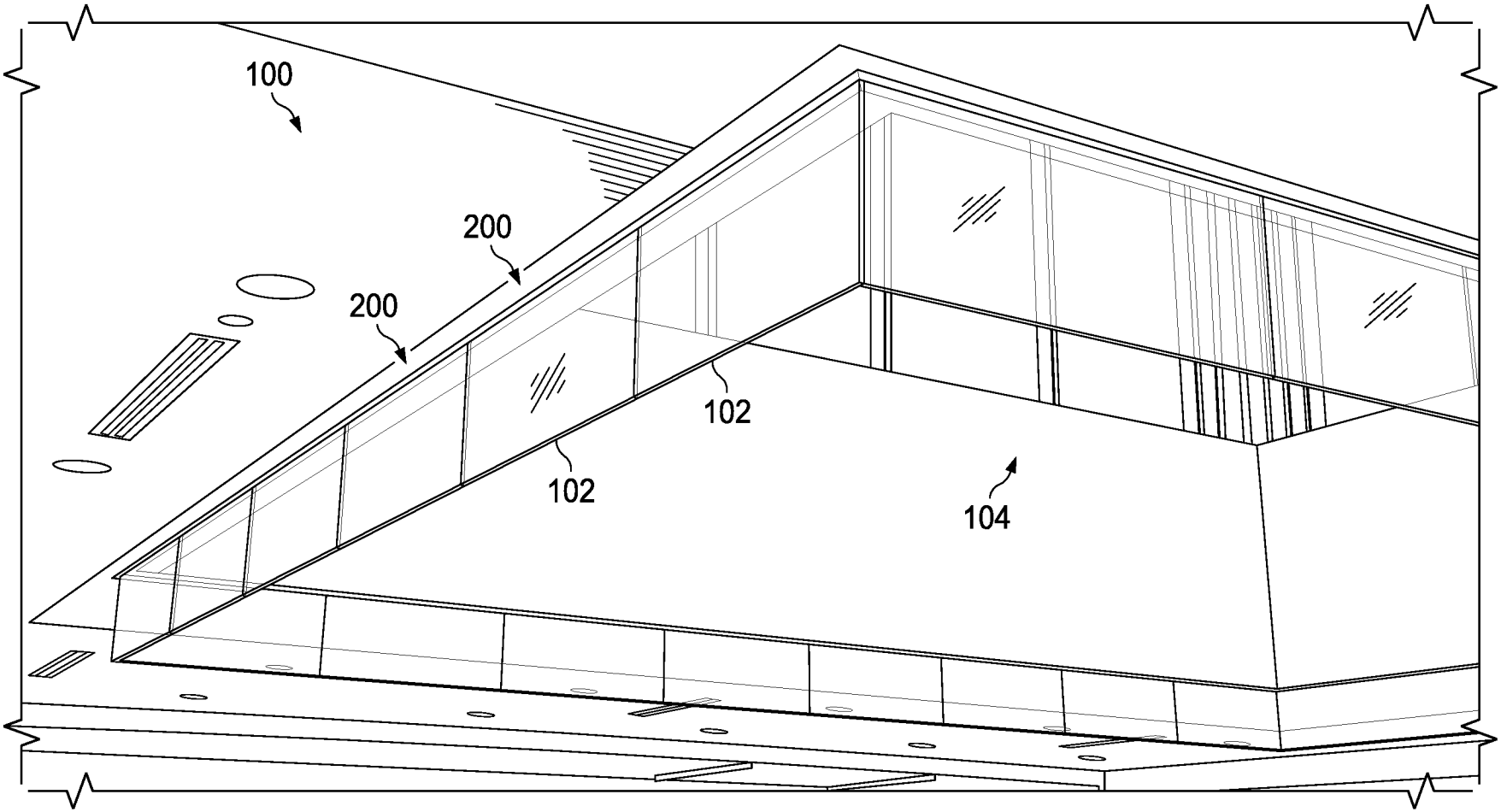
FIG. 1 is a schematic perspective view of a smoke baffle system installed into a ceiling according to an illustrative embodiment.

FIG. 1 is a schematic perspective view of a smoke baffle system anchored into an overhead structural support member according to an illustrative embodiment. The smoke baffle system 100 is configured to suspend a set of panels 102 from an overhead structural support member, such as a ceiling slab or a joist. Placement of the baffle system 100 around the perimeter of a slab opening 104 can corral smoke at the ceiling and reduce the amount of smoke that can pass from a lower floor of a building to a higher floor of the building.

In this non-limiting embodiment in FIG. 1, the smoke baffle system 100 is formed from a plurality of smoke baffle panel units 200, each of which is partially recessed within a ceiling to conceal the mounting hardware. Gaps between the set of panels 102 and the ceiling can be bridged by ceiling covers 900.

Figure 2:
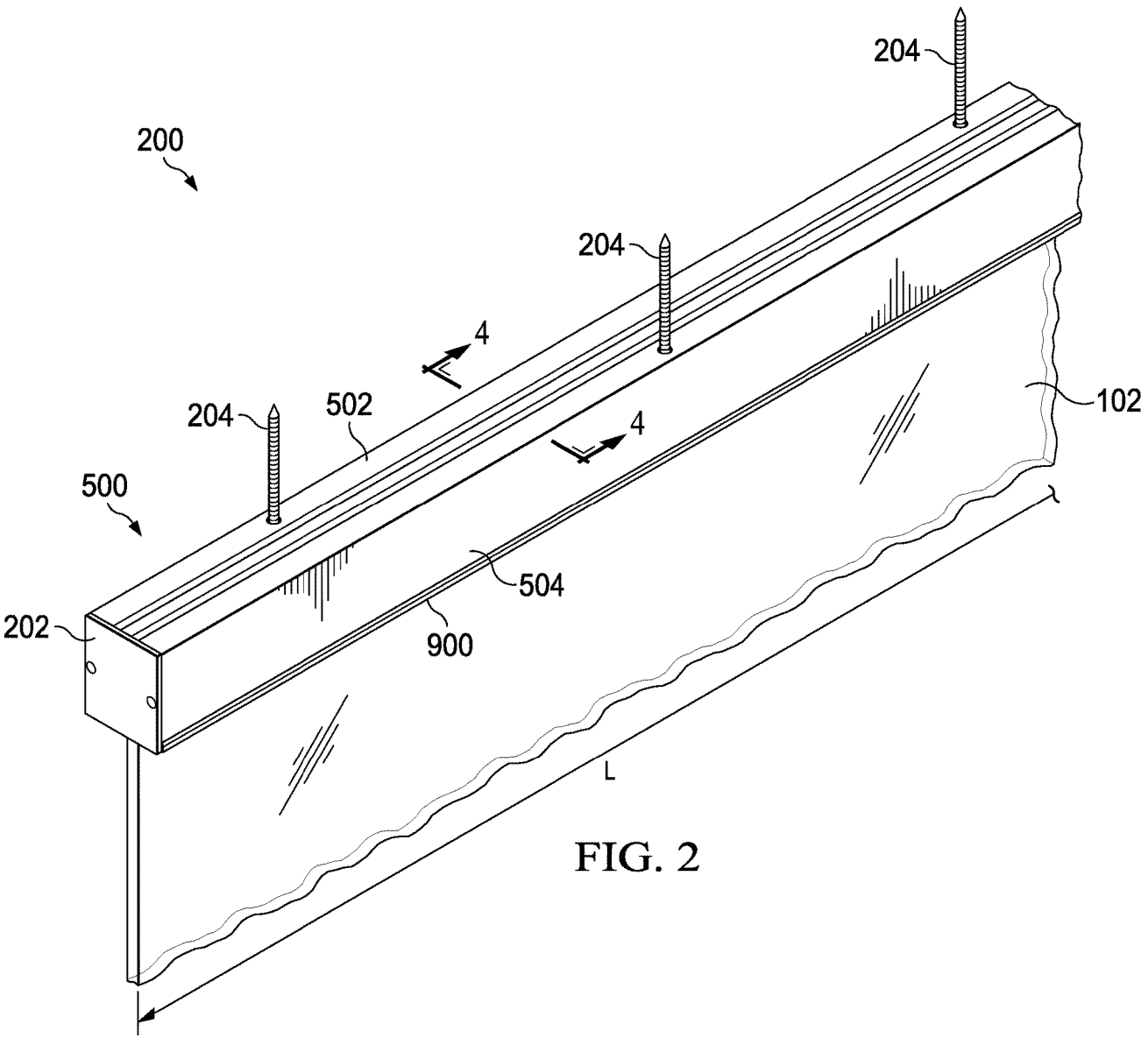
FIG. 2 is a schematic perspective view of a smoke baffle panel unit according to an illustrative embodiment.

FIG. 2 is a schematic perspective view of a smoke baffle panel unit in an assembled configuration according to an illustrative embodiment. The smoke baffle panel unit 200 includes a panel 102 suspended from a mounting rail 500. In a non-limiting embodiment, the mounting rail 500 is an elongated structure having a base 502 and a pair of opposing sidewalls 504 and 506 that form a mounting rail channel 508 (not shown). The mounting rail channel 508 can be described generally as having an inverted, U-shaped cross-section sized to conceal mounting hardware and an edge of the panel 102. Endcaps and ceiling covers, such as endcap 202 and ceiling cover 900, can be removably attached to the mounting rail 500 to conceal the mounting rail channel 508 and the mounting hardware located therein.

The mounting rail 500 of the smoke baffle panel unit 200 can be anchored into a structural support member by using a set of mounting fasteners 204. In this illustrative embodiment, the set of mounting fasteners 204 is a set of screws inserted through apertures disposed regularly throughout the base 502, i.e., outwardly from the inside of the mounting rail channel 508 and into the structural support member. Once the mounting rail 500 is installed, additional mounting rails can be aligned end-to-end for suspending a series of panels, which in turn forms the smoke baffle system 100 depicted in FIG. 1.

Figure 3:
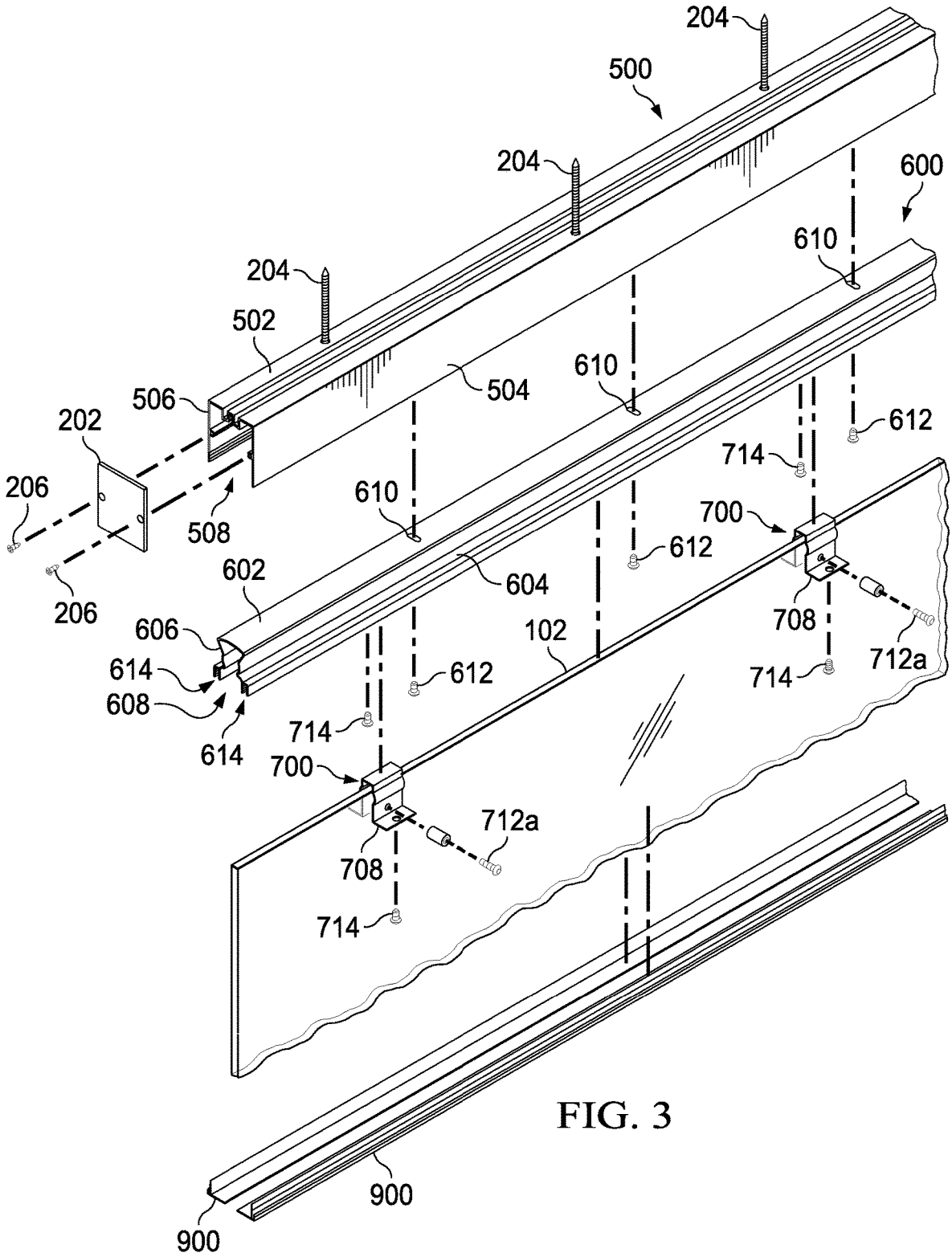
FIG. 3 is an exploded view of the smoke baffle panel unit according to an illustrative embodiment.

FIG. 3 is an exploded view of the smoke baffle panel unit according to an illustrative embodiment. As previously discussed, the smoke baffle panel unit 200 includes a mounting rail 500 configured to anchor the smoke baffle panel unit 200 to a structural support member. A panel 102 is suspended from the mounting rail 500 by an alignment rail 600. The panel 102 can be secured to the alignment rail 600 by a set of panel clamps 700 that are fastened to the panel 102.

In a non-limiting embodiment, the mounting rail 500 includes a pair of generally parallel sidewalls 504 and 506 attached at their respective proximate edges to a base 502. The base 502 has a first side that defines a generally planar surface configured to be secured against a structural support member and a second side that is opposite to the first side. The base 502 and the sidewalls 504 and 506 can be integrally formed. Alternatively, the base 502 and the sidewalls 504 and 506 can be formed separately and then subsequently assembled. In either event, the base 502 and the sidewalls 504 and 506 form the mounting rail channel 508, which is sized to receive the alignment rail 600.

The alignment rail 600 is an elongated structure that includes a first sidewall 604 and a second sidewall 604 attached at their respective proximate edges to a curved base 602. The exterior surface of the curved base 602 is a curved mating surface that engages with a curved surface 510 disposed on the second side of the base 502, i.e., the interior surface, of the mounting rail 500. The curved mating surfaces allows the alignment rail 600 to change an angle of engagement with the mounting rail 500 to mitigate the effects of a structural support member that is not substantially level. For example, if the mounting rail 500 were instead configured with a planar mating surface generally parallel to the structural support member, and the mating surface had a normal vector intersecting with the gravitational vector rather than parallel to the gravitational vector, then a panel secured directly to the planar mating surface would not be plumb and would experience a static rotational force that could compromise the integrity of the smoke baffle panel unit over time. The curved mating surfaces between the alignment rail 600 and the mounting rail 500, i.e. the curved base 602 and the curved surface 510, allows the panel 102 to be suspended plumb despite a lack of levelness in the structural support member.

In a non-limiting embodiment, a set of elongated apertures 610 are disposed throughout the curved base 602, extending substantially orthogonally to the proximate edges of the first sidewall 604 and the second sidewall 606. The alignment rail 600 is secured to the mounting rail 500 by a set of rail fasteners 612 that can be inserted through one of the sets of elongated apertures 610 formed in the curved base 302 and into one of a set of fastener receivers 512 in the curved surface 510 of the base 502 of the mounting rail 500. In one embodiment, the set of fastener receivers 512 is a threaded channel and the set of rail fasteners 612 is a set of threaded bolts configured to be screwed into the threaded channel. In this embodiment, the threaded channel extends an entire length L of the mounting rail 500. The set of elongated apertures 610 permits the alignment rail 600 to be rotated relative to the mounting rail 500 in an angular direction along a length of the set of apertures 610. The rotation allows a panel 102 attached to the alignment rail 600 to be plumb.

The panel 102 is suspended from the alignment rail 600 by a set of panel clamps 700. In this illustrative embodiment, the set of panel clamps 700 includes at least two panel clamps for each panel, and each panel clamp in the set of panel clamps 700 includes a pair of generally parallel clamp sidewalls 704 and 706 attached at their respective proximate edges to a clamp base 702. Flanges 708 and 710 are formed at the distal edges of clamp sidewalls 704 and 706, respectively. In one embodiment, a set of panel clamp fasteners 712 secure the set of panel clamps to the panel 102 via the clamp sidewalls 704 and 706, and a set of rail clamp fasteners 714 secure the set of panel clamps to the alignment rail 600 via the flanges 708 and 710.

In a non-limiting embodiment, the set of panel clamp fasteners 712 include bolts 712*a* and nuts 712*b*, and the sidewall 704 includes an aperture aligned with a corresponding aperture in sidewall 706. The two apertures can be aligned with one of a plurality of panel conduits 106 disposed regularly along an upper edge of the panel 102. A bolt 712*a* can be inserted through the sidewalls 704 and 706 and the panel conduit 106 and secured with a corresponding nut 712*b*. In the event that panel 102 is glass, a bushing 716 can be inserted into the panel conduit 106 to provide additional durability. In one embodiment, the bushing 716 can be formed from nylon.

In a non-limiting embodiment, the set of rail clamp fasteners 714 are bolts, and each of the flanges 708 and 710 include an aperture sized to receive the threaded body of one of the bolts 714. The threaded body of the bolts are configured to be received by fastener receiver 614 located at each of the distal edges of the sidewalls 604 and 606 of the alignment rail 600. The fastener receiver 614 can be threaded channels extending a length L of the alignment rail 600 and sized to receive the threaded body of the bolts, which allows the set of panel clamps 700 to be secured along any location along the length L of the alignment rail 600. The set of panel clamps 700 is secured by inserting bolts through the apertures in the flanges 708 and 710 and then screwing the bolts into a respective threaded channel. In another embodiment, the fastener receiver 614 can be flanges in which a plurality of apertures is disposed. In this other embodiment, apertures in the flanges 708 and 710 of the set of panel clamps 700 can be aligned with the apertures formed in flanges of the alignment rail 600 and secured by a set of rail clamp fasteners 714, e.g., nuts and bolts. While the embodiments described with particularity herein implement nuts and sometimes bolts, other conventional fasteners may be used instead.

In some embodiments, the alignment rail 600 includes a rail alignment feature 616 configured to engage with a clamp alignment feature 718 in each of the set of panel clamps 700, which facilitates alignment of the panel 102 within the alignment rail channel 608 before the panel 102 is secured to the alignment rail 600 by the set of rail clamp fasteners 714. In this illustrative embodiment, the rail alignment feature 616 is a pair of opposing convexities 616*a* and 616*b* projecting radially outward from each of the alignment rail sidewalls 604 and 606, and the clamp alignment feature 718 is a pair of opposing convexities 718*a* and 718*b* projecting radially outward from the clamp sidewalls 704 and 706. The convexities 616*a* and 616*b* can serve as a pair of parallel grooves in each of the interior surfaces of sidewalls 604 and 606, and the convexities 718*a* and 718*b* can serve as a pair of protrusions that can receive the pair of grooves, allowing a panel clamp 700 to be slidably engaged within the alignment rail channel 608. In one embodiment, each of the alignment rail sidewalls 604 and 606 are flexibly engaged with the curved base 602, allowing the distal edges of the alignment rail sidewalls 604 and 606 to flex apart from one another to allow the set of panel clamps 700 to be inserted into the alignment rail channel 608. Once the protrusions have been received into the grooves, the set of panel clamps 700 can be slidably moved along a length L of the alignment rail 600, which allows the panel 102 to be aligned within the alignment rail 600 (and the mounting rail 500).

The mounting rail channel 508 can be at least partially sealed to prevent inadvertent damage to mounting hardware or exposure to conditions that may compromise the integrity of the mounting hardware, or to conceal the mounting hardware to provide a desired aesthetic. As previously mentioned, the ends of the mounting rail 500 can be covered by an endcap 202. In one embodiment, the endcap 202 is attached to the mounting rail 500 by a set of endcap fasteners 206, which are depicted as screws. Each of the set of endcap fasteners 206 engage with a respective receiving conduit 514 or 516. In this example, the set of receiving conduits 514 and 516 extend an entire length L of the mounting rail 500 so that the same receiving conduits 514 and 516 can be used to secure an endcap to the opposite end of the mounting rail 500. At least one benefit that can be recognized by the use of these receiving conduits 514 and 516 is that if the mounting rail 500 is cut in a transverse plane, then the receiving conduits 514 and 516 are still exposed at the newly cut end so that the endcap 202 can still be secured to the receiving conduits 514 and 516 at the newly cut end without any additional modification.

The set of endcap fasteners 206 are depicted as screws but can take any other form that is known in the art. In some embodiments, the set of endcap fasteners 206 can be integrally formed with endcap 202, such as a flexible tab that can be friction fit into corresponding receiving conduits 514 and 516 exposed at the ends of the mounting rail 500.

The mounting rail channel 508 can also be partially concealed by a set of ceiling covers 900. The set of ceiling covers 900 include a body 902 that can be removably attached to the distal edges of the sidewalls 504 and 506 of the mounting rail 500 by a cover fastener 904 to partially conceal the elongated opening of the mounting rail channel 508. In one embodiment, set of cover fasteners 904 allows the set of ceiling covers 900 to be frictionally engaged to a set of ribs 518 and 520 disposed along the distal edges of the mounting rail sidewalls 504 and 506, respectively. In particular, the cover fastener 904 can include a pair of opposing walls 904*a* and 904*b* and a lip 904*c* configured to engage the distal edges of the set of mounting rail sidewalls and the set of ribs, e.g., sidewall 504 and set of ribs 518.

Figure 4:
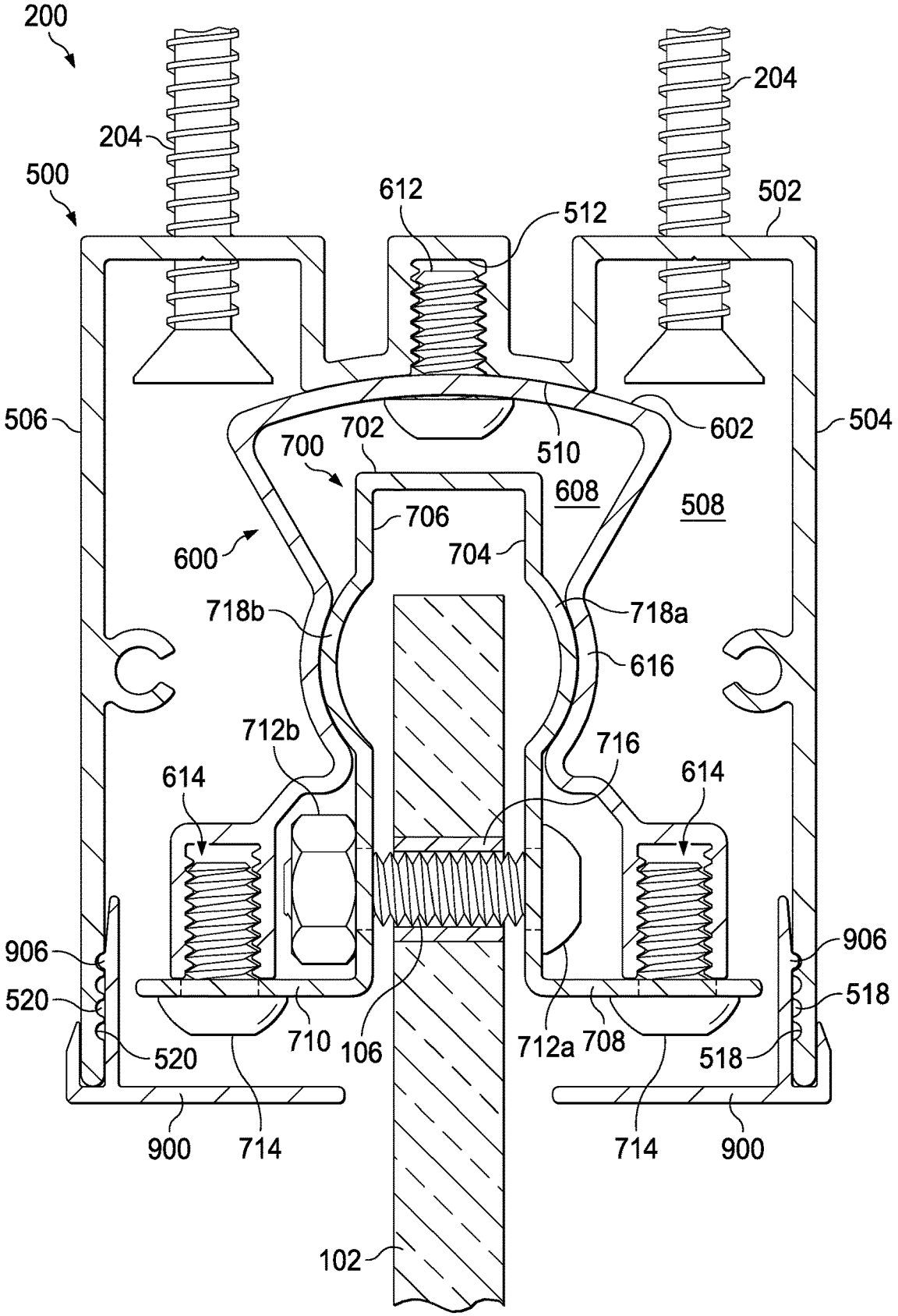
FIG. 4 is a section view of the smoke baffle panel unit according to an illustrative embodiment.

FIG. 4 is a schematic sectional view of a smoke baffle panel unit taken along line 4-4 in FIG. 2. The alignment rail 600 is coupled to the mounting rail 500 at curved mating surfaces formed from the curved base 602 of the alignment rail 600 and a curved surface 510 of the mounting rail 500. As already discussed, the curved mating surfaces allows alignment rail 600 to rotate in an angular direction, constrained by the orientation of the set of elongated apertures 610 formed in the curved base 602 of the alignment rail 600. The rotation permits a change in the angle of engagement between the alignment rail 600 and the mounting rail 500 so that the panel 102 can be plumb even if the base 502 of the mounting rail 500 is not level.

The set of panel clamps 700 is removably coupled to the panel 102 by a set of panel clamp fasteners 712 that pass through the clamp sidewalls 704 and 706, as well as the panel 102. In this illustrative embodiment, a bolt 712*a* is inserted through an aperture in the clamp sidewall 704, through a bushing 716 housed within a panel conduit 106, and through an aperture in the clamp sidewall 706, where the bolt 712*a* is secured with a nut 712*b*. When the smoke baffle panel unit 200 is in the assembled configuration, the set of panel clamps 700 is housed at least partially within the alignment rail channel 608. The set of rail alignment features 616 are configured to receive the set of clamp alignment features 718, facilitating the alignment of the panel 102 relative to the alignment rail 600 before the panel 102 is secured to the alignment rail 600 via the set of rail clamp fasteners 714.

Figure 5:
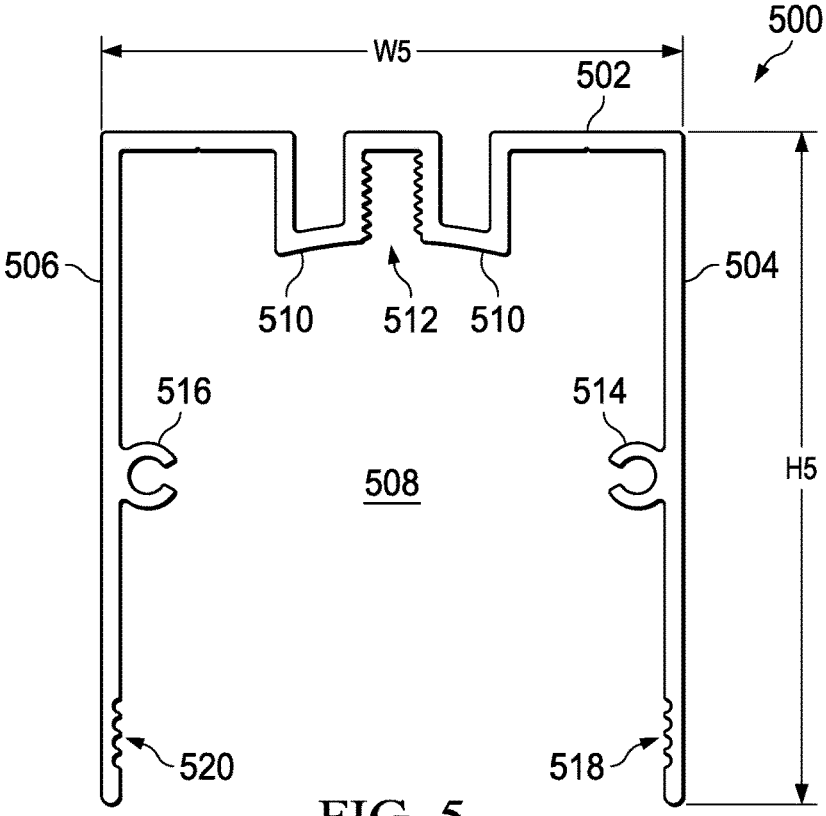
FIG. 5 is a schematic elevation view of a mounting rail according to an illustrative embodiment.

FIG. 5 is a schematic elevation view of a mounting rail according to an illustrative embodiment. The mounting rail 500 has a width W5, a height H5, and a length L taken orthogonally to the width and height dimensions. In one embodiment, the mounting rail 500 can have a width between 57.15 mm-69.85 mm, a height between 66.15 mm-80.85 mm, and a length between 5212.08 mm-6370.32 mm. In a more particular embodiment, the mounting rail 500 can have a width between 60.33 mm-66.67 mm, a height between 69.82 mm-77.18 mm, and a length between 5501.64 mm-6080.76 mm. Even more particularly, the mounting rail 500 can have a width of about 63.5 mm, a height of about 73.5 mm, and a length of about 5791.2 mm.

Figure 6:
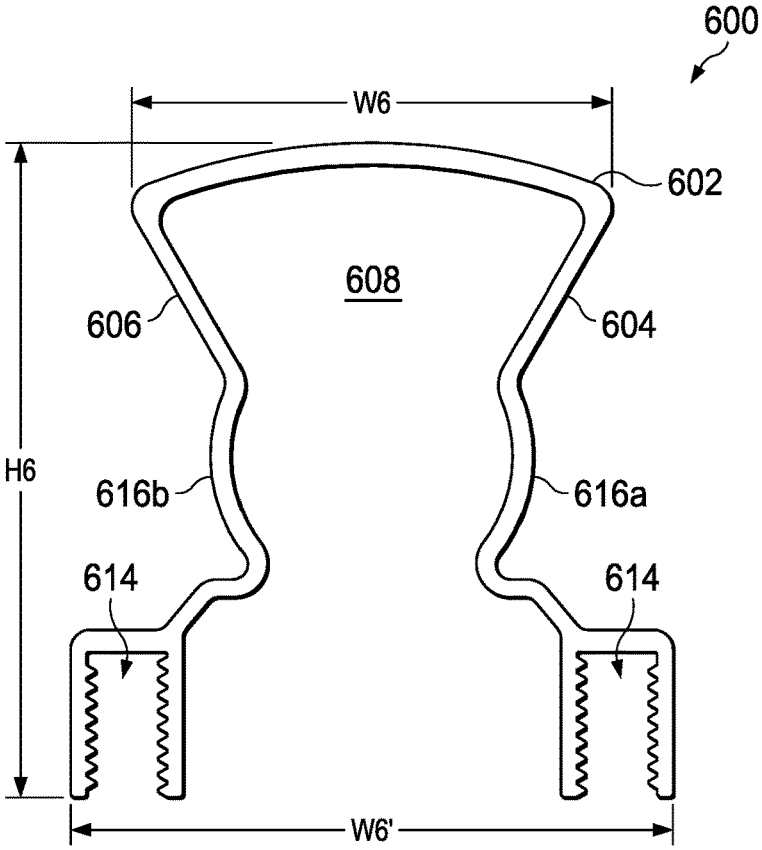
FIG. 6 is a schematic elevation view of an alignment rail according to an illustrative embodiment.

FIG. 6 is a schematic elevation view of an alignment rail according to an illustrative embodiment. The alignment rail 600 has a first width W6, a second width W6', a height H6, and a length L taken orthogonally to the width and height dimensions. In one embodiment, the alignment rail 600 can have a first width between 34.47 mm-42.13 mm, second width between 36 mm-44 mm, a height between 46.98 mm-57.42 mm, and a length between 5212.08 mm-6370.32 mm. In a more particular embodiment, the alignment rail 600 can have a first width between 36.39 mm-40.21 mm, a second width between 38 mm-42 mm, a height between 49.59 mm-54.81 mm, and a length between 5501.64 mm-6080.76 mm. Even more particularly, the alignment rail 600 can have a first width of about 38.3 mm, a second width of about 40 mm, a height of about 52.2 mm, and a length of about 5791.2 mm.

Figure 7:
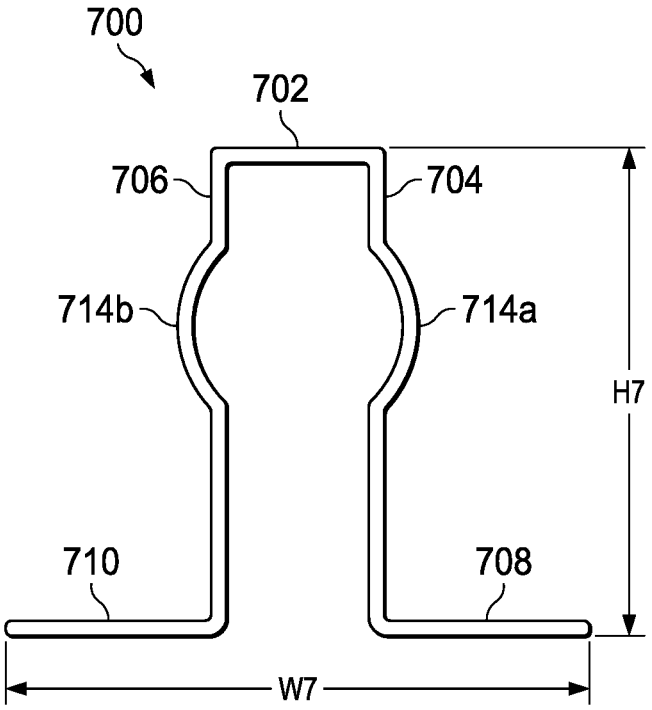
FIG. 7 is a schematic elevation view of a panel clamp according to an illustrative embodiment.

FIG. 7 is a schematic elevation view of a panel clamp according to an illustrative embodiment. The panel clamp 700 has a width W7, a height H7, and a length L7 taken orthogonally to the width and height dimensions. In one embodiment, the panel clamp 700 can have a width between 46.8 mm-57.2 mm, a height between 40.68 mm-79.72 mm, and a length between 36 mm-44 mm. In a more particular embodiment, the panel clamp 700 can have a width between 49.4 mm-54.6 mm, a height between 42.94 mm-47.46 mm, and a length between 38 mm-42 mm. Even more particularly, the panel clamp 700 can have a width of about 52 mm, a height of about 45.2 mm, and a length of about 40 mm.

Figure 8:
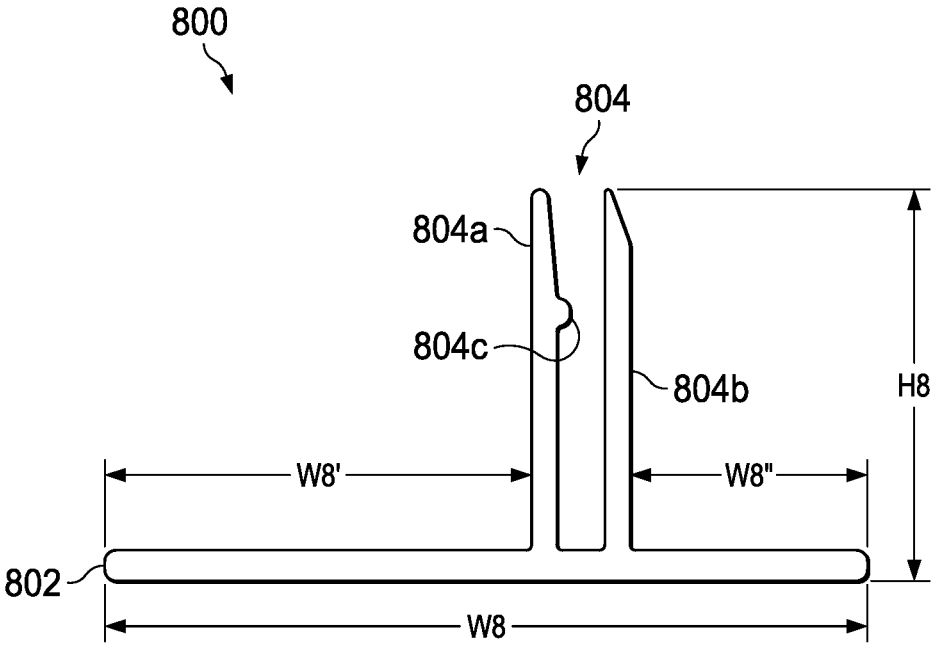
FIG. 8 is a schematic elevation view of a T-shaped ceiling cover according to an illustrative embodiment.

FIG. 8 is a schematic elevation view of a T-shaped ceiling cover according to an illustrative embodiment. The ceiling cover 800 includes a body 802 configured to be attached to a mounting rail 500 by a cover fastener 804. In a non-limiting embodiment, the cover fastener 804 includes a pair of opposing walls 804*a* and 804*b* and a lip 804*c* configured to engage the distal edges of the set of mounting rail sidewalls and the set of ribs, e.g., sidewall 504 and set of ribs 518. The ceiling cover 800 can be used instead of ceiling cover 900 in the event that a gap exists between the longitudinal edges of the mounting rail 500 and the ceiling. The cover fastener 804 is disposed between the width W8 of the body to divide the body into a first width W8' to at least partially conceal the gap between the panel 102 and the longitudinal edge of the mounting rail channel 508, and a second width W8" to conceal the gap between the longitudinal edge of the mounting rail 500 and the ceiling.

The ceiling cover 800 can have a width W8, a height H8, and a length L taken orthogonally to the width and height dimensions. In one embodiment, the ceiling cover 800 can have a width between 31.41 mm-38.39 mm, a height between 16.11 mm-19.69 mm, and a length between 5212.08 mm-6370.32 mm. In a more particular embodiment, the ceiling cover 800 can have a width between 33.16 mm-36.64 mm, a height between 17 mm-18.8 mm, and a length between 5501.64 mm-6080.76 mm. Even more particularly, the ceiling cover 800 can have a width of about 34.9 mm, a height of about 17.9 mm, and a length of about 5791.2 mm.

Figure 9:
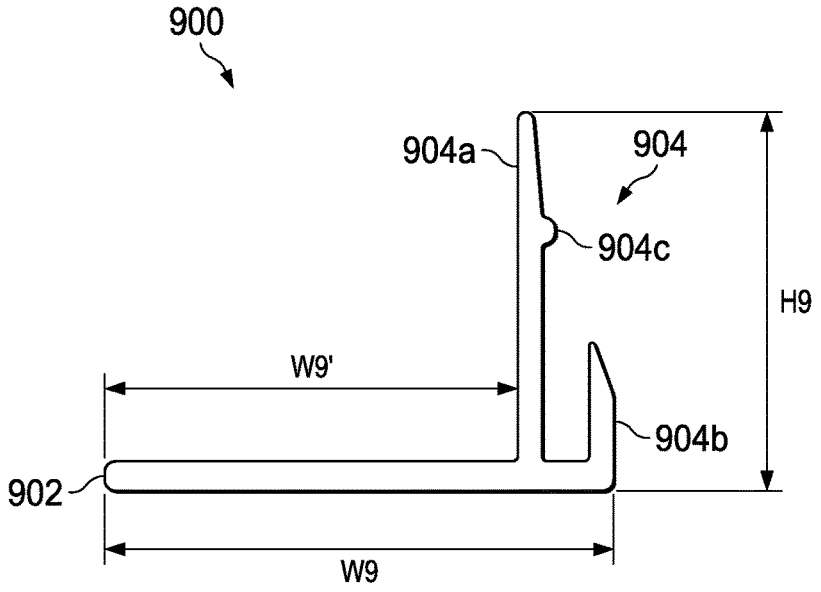
FIG. 9 is a schematic elevation view of an L-shaped ceiling cover according to an illustrative embodiment.

FIG. 9 is a schematic elevation view of a L-shaped ceiling cover according to an illustrative embodiment. The ceiling cover 900 includes a body 902 configured to be attached to a mounting rail 500 by a cover fastener 904 as previously described.

The ceiling cover 900 can have a width W9, a height H9, and a length L taken orthogonally to the width and height dimensions. In one embodiment, the ceiling cover 900 can have a width between 21.6 mm-26.4 mm, a height between 16.11 mm-19.69 mm, and a length between 5212.08 mm-6370.32 mm. In a more particular embodiment, the ceiling cover 900 can have a width between 22.8 mm-25.2 mm, a height between 17.00 mm-18.80 mm, and a length between 5501.64 mm-6080.76 mm. Even more particularly, the ceiling cover 900 can have a width of about 24 mm, a height of about 17.9 mm, and a length of about 5791.2 mm. The width W9' can be selected to at least partially conceal the gap between the panel 102 and the longitudinal edge of the mounting rail channel 508.

Figure 10:
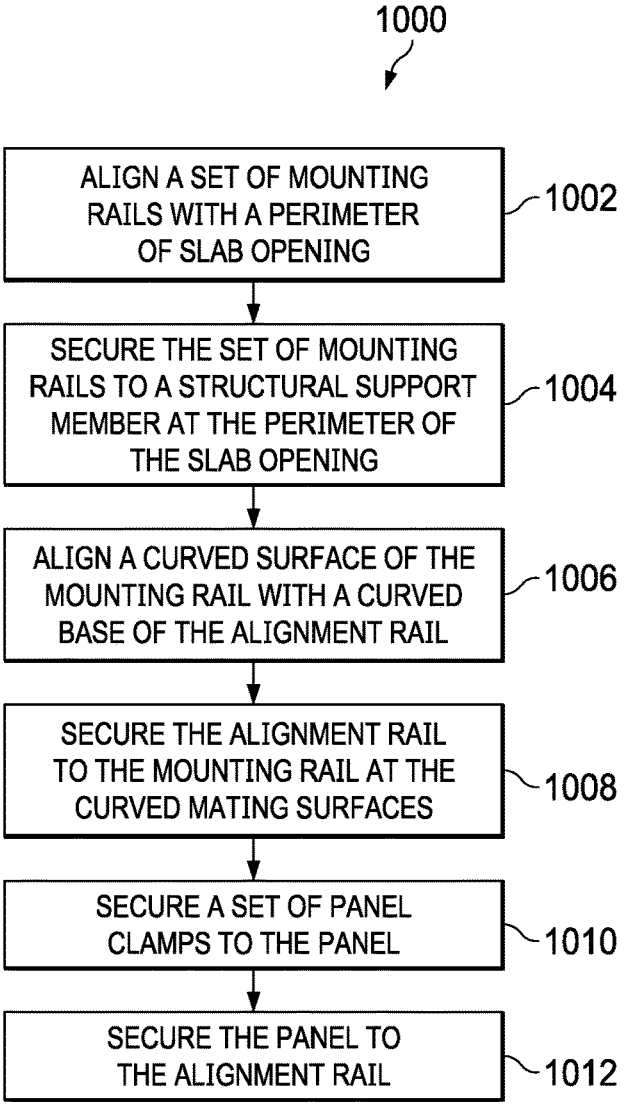
FIG. 10 is a flowchart of a process for installing the smoke baffle system according to an illustrative embodiment.

FIG. 10 is a flowchart of a process for installing a smoke baffle system formed from a set of smoke baffle panel units according to an illustrative embodiment. Flowchart 1000 begins at Step 1002 by aligning a set of mounting rails with a perimeter of a slab opening. At Step 1004, the set of mounting rails are secured to a structural support member at the perimeter of the slab opening. In a non-limiting embodiment, the set of mounting rails are secured to the structural support member by inserting mounting rail fasteners through a base of the mounting rail and into the structural support member.

At Step 1006, a curved surface of the mounting rail is aligned with a curved base of an alignment rail. At Step 1008, the alignment rail is secured to the mounting rail at the curved mating surfaces formed from the curved surface of the mounting rail and the curved base of the alignment rail. In a non-limiting embodiment, securing the alignment rail to the mounting rail includes inserting a set of rail fasteners through a set of elongated apertures formed in the curved base of the alignment rail.

In Step 1010, a set of panel clamps is secured to the panel. In a non-limiting embodiment, the set of panel clamps is secured to the panel by inserting a nylon bushing through a panel conduit, then threading a bolt through the panel clamp and the bushing in the panel conduit, as previously described. In embodiments where the panels and panel clamps are already attached, flowchart 1000 may proceed directly from Step 1008 to Step 1012. In Step 1012, the panel is secured to the alignment rail. In a non-limiting embodiment, securing the panel to the alignment rail further comprises inserting the set of panel clamps into an alignment rail channel so that a rail alignment feature engages with a clamp alignment feature, and securing the set of panel clamps to the alignment rail, as previously described. Optionally, the panel can be rotated in an angular direction that is constrained by the relative movement of the rail fasteners within the set of elongated apertures in the curved base of the alignment rail. In some embodiments, the step of inserting the set of panel clamps into the alignment rail channel includes engaging a clamp alignment feature of the set of panel clamps with a rail alignment feature of the alignment rail and sliding the clamp alignment feature along the rail alignment feature to align the set of panel clamps within the alignment rail channel.

Flowchart 1000 can also include the optional steps of aligning each of the panels in the smoke baffle system and securing at least one of an endcap or a ceiling cover to the mounting rail to at least partially enclose the mounting rail channel.

Advantageously, certain steps of this flowchart, e.g., Step 1002 and Step 1004 and optionally Step 1006, can be performed on different days from the remaining Steps, allowing the installation of the smoke baffle system to begin during construction, while the support structures are exposed and easily accessible. Installation and alignment of the actual panels can be completed later when the risk of damage is reduced.

While this invention has been particularly shown and described with reference to preferred embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A system for suspending a set of panels, the system comprising:

a mounting rail including a base having a first side and a second side, wherein the first side defines a planar surface configured to be secured against a structural support member, and wherein the second side includes a curved surface;

an alignment rail rotatably secured to the mounting rail along a pair of curved mating surfaces, wherein the alignment rail includes a curved base, and wherein the pair of curved mating surfaces is formed from the curved surface of the mounting rail and the curved base of the alignment rail; and a panel secured to the alignment rail.

2. The system of claim 1, wherein the mounting rail further comprises:

a first mounting rail sidewall and a second mounting rail sidewall attached at their respective proximate edges to the base, wherein the first mounting rail sidewall, the second mounting rail sidewall, and the base are arranged to define a mounting rail channel configured to receive the alignment rail, and wherein the curved surface is disposed on the second side of the base, within the mounting rail channel.

3. The system of claim 2, wherein at least one of the first mounting rail sidewall and the second mounting rail sidewall comprises a receiving conduit exposed at an end of the mounting rail, and wherein the system further comprises:

a set of endcaps configured to be secured to the end of the mounting rail by the receiving conduit.

4. The system of claim 2, wherein at least one of the first mounting rail sidewall and the second mounting rail sidewall comprises a set of ribs along a distal edge, and wherein the system further comprises:

a set of covers configured to engage the set of ribs.

5. The system of claim 1, wherein the alignment rail further comprises:

a first alignment rail sidewall and a second alignment rail sidewall attached at their respective proximate edges to the curved base, wherein the first alignment rail sidewall, the second alignment rail sidewall, and the curved base are arranged to define an alignment rail channel configured to at least partially receive an edge of the panel.

6. The system of claim 1, wherein:

the curved surface of the mounting rail comprises a set of fastener receivers;

the curved base of the alignment rail comprises a set of elongated apertures at least partially aligned with the set of fastener receivers; and the alignment rail is secured to the mounting rail by a set of rail fasteners inserted through the set of elongated apertures and into the set of fastener receivers.

7. The system of claim 6, wherein the set of fastener receivers is a threaded channel that is coextensive with a length of the curved surface.

8. The system of claim 7, wherein the set of elongated apertures are oriented orthogonally to the length of the curved surface.

9. The system of claim 1, wherein:

the curved surface of the mounting rail is a convex curvature and the curved base is a concave curvature; or the curved surface of the mounting rail is the concave curvature and the curved base is the convex curvature.

10. The system of claim 1, wherein the panel is secured to the alignment rail by a set of panel clamps.

11. The system of claim 10, wherein each of the set of panel clamps comprises:

a first clamp sidewall having a first proximate edge and a first distal edge;

a second clamp sidewall having a second proximate edge and a second distal edge, the second clamp sidewall connected to the first clamp sidewall at their respective proximate edges by a clamp base; and wherein:

the first clamp sidewall includes a first flange at the first distal edge; and the second clamp sidewall includes a second flange at the second distal edge.

12. The system of claim 11, wherein:

the set of panel clamps is attached to the panel via the first sidewall and the second sidewall; and the set of panel clamps is attached to the alignment rail via the first flange and the second flange.

13. The system of claim 12, wherein the alignment rail further comprises:

a first alignment rail sidewall and a second alignment rail sidewall attached at their respective proximate edges to the curved base, wherein the first alignment rail sidewall, the second alignment rail sidewall, and the curved base are arranged to define an alignment rail channel configured to at least partially receive an edge of the panel; and a threaded channel disposed along a distal edge of each mounting rail sidewall, the threaded channels configured to engage one of the first flange and the second flange.

14. The system of claim 10, wherein the set of panel clamps is configured to be slidably engaged within the alignment rail channel.

15. The system of claim 14, wherein:

each of the set of panel clamps includes a clamp alignment feature; and the alignment rail includes a rail alignment feature substantially coextensive with a length of the alignment rail, wherein the clamp alignment feature is configured to be slidably engaged with the rail alignment feature.

16. The system of claim 15, wherein:

the clamp alignment feature is a first convexity that projects radially outward from at least one sidewall of the set of panel clamps; and the rail alignment feature is a second convexity that projects radially outward from at least one sidewall of the alignment rail.

* * * * *